United States Patent [19]

Vetter

[11] Patent Number: 4,461,703

[45] Date of Patent: Jul. 24, 1984

[54] SWIMMING POOL AERATION CLEANING SYSTEM

[76] Inventor: Heinz H. Vetter, 20476 Barnard Ave., Walnut, Calif. 91789

[21] Appl. No.: 237,742

[22] Filed: Feb. 24, 1981

[51] Int. Cl.[3] ..... E04H 3/16

[52] U.S. Cl. ..... 210/169; 210/196; 210/198.1; 261/DIG. 75; 4/490

[58] Field of Search ..... 261/DIG. 75, 36 R; 210/169, 198.1, 194, 196; 4/490, 492, 542

[56] References Cited

U.S. PATENT DOCUMENTS

| | | | |
|---|---|---|---|
| 3,577,571 | 5/1971 | Bellinson et al. | 4/490 |
| 3,640,516 | 2/1972 | Willinger | 261/DIG. 75 |
| 3,738,620 | 6/1973 | Ennis | 210/169 |
| 3,765,432 | 10/1973 | Goodin | 4/490 |
| 4,072,612 | 2/1978 | Daniel | 210/169 |
| 4,141,101 | 2/1979 | Gibellina | 210/169 |
| 4,271,099 | 6/1981 | Kukla | 210/169 |
| 4,304,740 | 12/1981 | Cernoch | 261/DIG. 75 |

*Primary Examiner*—Benoit Castel

*Attorney, Agent, or Firm*—Leo R. Carroll

[57] ABSTRACT

An aeration device for use in a swimming pool system wherein a pump draws water from a lower portion of a body of water through a filter and returns it to the body of water via a return conduit, and comprises a tubular aeration member positioned adjacent to a conduit to the pump, and extending above the water line, thus to admix atmospheric air with water drawn by the pump via the conduit from the lower portion of the body of water. A flexible hose preferably extends into the body of water and is connected with the pump via a return conduit, and the hose is moved about and supported under the action of aerated water passing therethrough to spread aerated water through the body of water.

2 Claims, 3 Drawing Figures

SWIMMING POOL AERATION CLEANING SYSTEM

BACKGROUND OF THE INVENTION

The desirability or necessity for aeration of certain bodies of water, such as swimming pools, is well known, aeration serving to purify the water, reduce the bacteria count and reduce the necessity for or quantities of chemicals required for these purposes. Prior devices for aeration of such bodies of water have involved one or more shortcomings or defects, including relatively high cost, complexity, inconvenience and work required for installation and removal, and not intermixing and spreading the aerated water throughout the body of water.

Some devices or systems require modification of the pool structure or system, with attendant expense and work.

Prior aeration systems or devices are disclosed in U.S. Pat. Nos. 3,074,078; 3,273,717; 3,615,013; 3,640,516; 3,738,620; 4,072,612; 4,141,101; 4,271,099; and 4,304,740.

The present invention provides an aeration device for use in pool systems which is inexpensive, quickly and conveniently installable and removable, requires no special fabrication, provides high effectiveness in reducing bacterial count in the water, substantially reduces the requirements for and the cost of pool chemicals, and spreads and intermixes aerated water throughout the body of water.

SUMMARY OF THE INVENTION

The foregoing advantages and results are provided by an aeration device for use in pool systems, wherein a pump draws water via a conduit from a lower portion of the pool through a filter and returns filtered water via a conduit to the pool, the aeration device comprising a tubular aeration member which extends above the pool water line and is positioned adjacent to the conduit to the pump to admix atmospheric air with water drawn by the pump from the lower portion of the pool. The aeration system preferably includes a flexible hose extending into the pool water connected with the pump via a return conduit so that the hose is moved under action of the aerated water passing therethrough and is supported thereby, thus to spread aerated water through the pool. The device of the invention is typically used in connection with the skimmer structure of a pool (a small reservoir communicates with the surface portion of pool water and the bottom wall opening or drain communicates with the conduit to the pump). Conventionally, a directional flow valve is positioned at the bottom wall opening or drain, and the tubular aeration member is supported by this valve.

The device of the invention provides highly effective and inexpensive means for aerating the water to maintain low bacteria count in the water of pools and the like. Thus, it substantially reduces requirements for pool chemicals. It is entirely compatible with existing pool systems and filtration equipment.

DESCRIPTION OF THE PREFERRED EMBODIMENT

Figure 1:
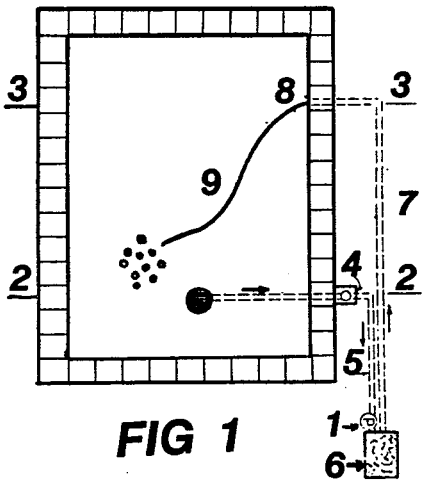
FIG. 1 is a plan view of a conventional swimming pool, pump, conduit and skimmer system, with which the invention is utilized.
Figure 2:
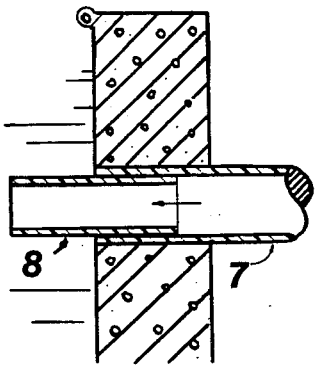
FIG. 2 is a sectional view taken at line 2—2 in FIG. 1, showing a skimmer system and directional valve in association with the aeration device of the invention.

Referring to the drawings, FIG. 1 illustrates a conventional swimming pool installation or system, including a pump 1 connected with a drain 2 in the deepest portion of the pool, by a conduit 3 and a second conduit 5 (FIGS. 1 and 2). The pump 1 forces the water through filter 6 from which it passes via conduit 7 to return to the pool via fitting or coupling 8 and flexible hose 9 (FIGS. 1 and 3).

The conventionl swimming pool skimmer arrangement, shown in FIG. 2, includes a small water reservoir, a horizontal opening therefrom communicating with the upper level of pool water, and a vertical opening in the bottom wall of the reservoir. A conventional directional valve 10 is positioned in this bottom wall opening, as shown. With the conventional directional valve 10 positioned as shown, with its curvilinear portion fitting within the bottom wall opening, flow from the skimmer reservoir to the pump is blocked, and flow is permitting under the action of pump 1 from drain 2 in the pool bottom via conduits 3 and 5 to the pump 1. The valve 10 is used in two positions which are 180° apart. With the valve positioned with its depending curvilinear portion (shown in cross-section in FIG. 2), flow is blocked from conduit 3 to the pump, and water is permitted to flow from the upper level of pool water via the skimmer and conduit 5 to the pump and filter, thus to remove debris, leaves, etc. from the upper level of pool water. The size of the passage through tube 11 governs the volume of air drawn in for aeration of the water. To reduce the effective inside diameter of tube 11, restriction may be placed on the tube, such as by applying tape over a portion of the tube end opening.

The aeration tube or device 11 of the invention is positioned, as shown, with its upper end portion extending to the atmosphere above the pool water level, and with its lower end portion supported in the bottom wall opening of the skimmer by resting on the depending curvilinear portion of valve 10. With the aeration tube 11 thus positioned and with the pump in operation, substantial aeration of the water is produced by air drawn through tube 11 by action of the pump and the flow of water through conduits 3 and 5 at their juncture shown in FIG. 2, water being drawn via the annular space between tube 11 and the inner wall of valve 10, while air is drawn downwardly through tube 11 to admix with the water, the air passing between the depending portion of valve 10 and the inner wall of the conduit. The water passes via the filter 6, conduit 7 and flexible hose 9 to the pool. The aerated water, the water containing air bubbles, provides a cleaning and purifying action, the oxygenation of the water provided by the aeration effected by the invention, greatly reducing the bacteria count and providing a cleaning and purifying action.

Figure 3:
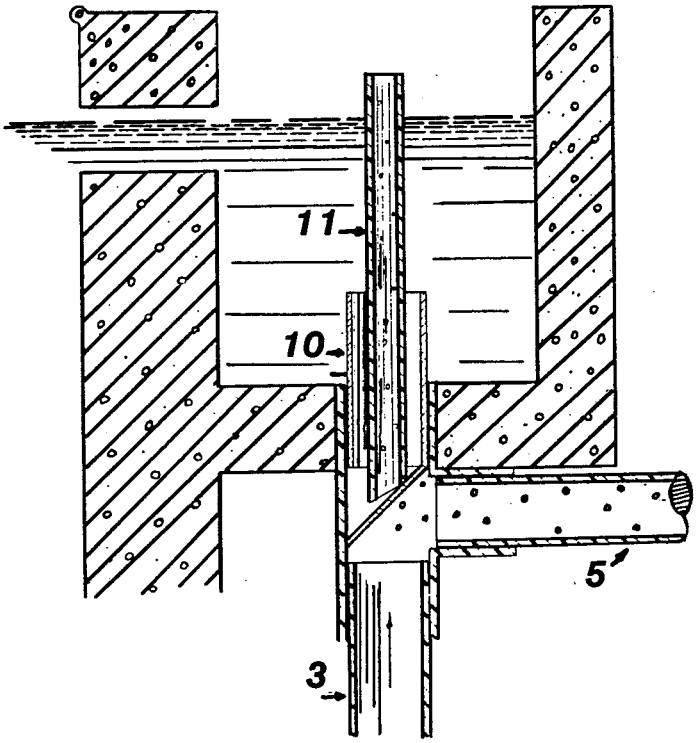
FIG. 3 is a sectional view, taken at line 3—3 in FIG. 1, showing a conduit and fitting for returning aerated water from the pump to the pool.

As indicated in FIGS. 1 and 3, flexible hose 9 is secured to the end portion of plastic fitting 8 and extends into the pool water. The action of the aerated water passing through the hose produces a random motion of the flexible hose and thus a sweeping effect of the hose, thus distributing the aerated water and bubbles throughout the water in the pool. The flexible hose is largely supported at mid-depth of the pool water by the buoyancy provided by the aerated water in the hose, thus further aiding in good distribution of the aerated water throughout the pool water.

The invention has been described with reference to its illustrated preferred embodiment. Persons skilled in the art may, upon exposure to the teachings herein, conceive variations in the mechanical development of the components therein. Such variations are deemed to be encompassed by the disclosure, the invention being delimited only by the appended claims.

I claim:

1. A pool aeration cleaning system comprising:

a swimming pool including a bottom wall having a first bottom drain opening therein and a plurality of sides enclosing a body of water;

a water recirculating pump having inlet and outlet water connections;

a water cleansing filter connected to said pump outlet;

a return conduit to discharge cleansed water from said filter under pressure from said pump;

a drain conduit connected between said first bottom drain opening and said water cleansing filter;

a skimmer structure positioned adjacent said drain conduit and one said pool side wall, comprising a reservoir communicating with the surface level of the pool water, having a second bottom wall with a second bottom drain opening therein communicating with said drain conduit;

a directional flow valve positioned in said second bottom drain opening for selectively directing water to the filter from said first bottom drain opening via said drain conduit or from said surface pool water level via the skimmer reservoir, said directional flow valve comprising a tubular portion positioned in said second bottom drain opening, and a depending curvilinear portion inclined to the axis of and configured to fit within the second bottom wall opening and said drain conduit, in adjustable fluid communication with said drain conduit so that rotation of said curvilinear position will adjust the proportion of fluid flow from said reservoir relative to fluid flow from said first bottom drain opening to said pump; and a tubular aeration member positioned coaxially within said tubular portion and above said depending curvilinear portion of said directional flow valve, said aeration member having a first open end extending above said pool water surface and a second lower open end in air communication with selected water flow to said filter from said reservoir, so that when said water flow from said skimmer reservoir is selectively blocked, atmospheric air will be drawn from within said tubular aeration member by the pump and admixed with water flow from said first bottom drain opening to the filter.

2. The apparatus according to claim 7, and further including:

flexible hose means extending into the pool and connected to the pump outlet via the filter and the return conduit, the hose being moved about under the action of the aerated water pressing therethrough and being supported in the water by the aerated water passing therethrough, whereby aerated water is spread throughout the water in the pool.

* * * * *